US005802817A

United States Patent [19]

Hood

[11] Patent Number: 5,802,817

[45] Date of Patent: Sep. 8, 1998

[54] METHOD AND APPARATUS FOR OPENING A MESH BAG

[76] Inventor: Charles T. Hood, Rte. 4, Box 209, Allen Rd., Commerce, Ga. 30529

[21] Appl. No.: 637,876

[22] Filed: Apr. 25, 1996

[51] Int. Cl.[6] ..... B65B 43/26

[52] U.S. Cl. ..... 53/459; 53/573; 53/468; 53/469; 53/385.1

[58] Field of Search ..... 53/570, 571, 572, 53/573, 459, 468, 469, 385.1, 384.1

[56] References Cited

U.S. PATENT DOCUMENTS

| | | | |
|---|---|---|---|
| 3,495,378 | 2/1970 | Kipers | 53/571 |
| 3,522,691 | 8/1970 | Adcox | 53/571 |
| 3,590,553 | 7/1971 | Formo | 53/572 |
| 3,691,715 | 9/1972 | Kelly et al. | 53/571 |
| 4,172,349 | 10/1979 | Lipes | 53/572 |
| 4,541,228 | 9/1985 | Peterson . | |
| 4,644,735 | 2/1987 | Savigny . | |
| 4,715,167 | 12/1987 | Savigny . | |
| 5,177,939 | 1/1993 | Lipes | 53/572 |
| 5,421,143 | 6/1995 | Savigny . | |
| 5,442,898 | 8/1995 | Gabree et al. . | |

*Primary Examiner*—James F. Coan
*Assistant Examiner*—John Paradiso
*Attorney, Agent, or Firm*—Needle & Rosenberg, P.C.

[57] ABSTRACT

An automatic bag opening apparatus for sequentially opening at least one bag, preferably a mesh bag, comprising a frame, a wicket for holding the bag wherein the mesh bag adjacent the forward end of the wicket is the outermost mesh bag, a first clamp disposed adjacent the forward end of the wicket, an air dam slidably mounted to the frame, an opener clamp slidably mounted to the frame, and a nozzle or other means for directing a pressurized fluid through at least a portion of the first, or outer, side of the outermost mesh bag adjacent its open end and onto the air dam. In operation, the first clamp is positioned in contact with the outermost mesh bag, the air dam is located adjacent the open end of the first side of the outermost mesh bag the pressurized fluid is directed through a portion of the open end of the first side of the outermost mesh bag adjacent its open end and onto the air dam, which causes the portion of the mesh bag through which the pressurized fluid is directed to move towards the air dam. The next step involves moving the opener clamp to grasp the portion of the first side of the outermost bag and then moving the opener clamp a desired distance away from the forward end of the bag holding means, whereby the outermost mesh bag is opened by the opener clamp grasping its first side and the first clamp holding its second side. The present invention also encompasses a second clamp disposed on the frame for use when sequentially opening a plurality of bags.

42 Claims, 9 Drawing Sheets

METHOD AND APPARATUS FOR OPENING A MESH BAG

BACKGROUND OF THE INVENTION

1. Field of the Invention

The present invention relates generally to automatic bagging systems. More specifically, the present invention relates to an apparatus and method for opening a mesh bag and for removing an open bag without ripping or tearing it from its holding device.

2. Background Art

There are a wide variety of automatic bagging systems available. Automatic bagging systems are often used to package produce, such as fresh fruits and vegetables or similar items. These systems package the desired products orderly and efficiently and, accordingly, reduce operation costs. Thus, automatic baggers have become necessary equipment in businesses concerned with increased efficiency and product rates.

Many of the automatic bagging systems known in the prior art use bags made from petroleum-based plastics, such as polyurethane or polyethylene. Although non-porous plastic bags are useful for some products, other products are better suited to be packaged in mesh bags. One of the primary considerations is that mesh bags freely breathe to ensure the products in them to remain fresh longer. Examples of products that are preferably packaged in mesh bags include potatoes, oranges, lemons, onions, garlic, flower bulbs, and the like. Thus, non-porous plastic bags are not appropriate for some of these products.

Mesh bags, however, cannot be opened the same way as a conventional plastic bag in automatic bagging systems. For example, the prior art systems may operate by directing a blast of air into the bag, which causes the bag to expand and open. Such a design is disclosed in U.S. Pat. No. 5,442,898, issued to Gabree et al., which is hereby incorporated by reference. The '898 patent teaches that a supply of air is guided into a wicketed bag by a pivotable plate and after the bag is opened by the air supply, the plate moves so that it clamps open the side of the opened bag. Obviously, this type of system would not work for a mesh bag because the air would traverse through the porous mesh bag without opening it. Therefore, a need exists in the art to open mesh bags so that they can effectively be used to package products.

Other prior art disclosures, such as that in U.S. Pat. Nos. 4,715,167 and 5,421,142, which are also incorporated by reference, teach opening plastic bags using suction against the front side of the bag. However, suction is generally ineffective against the porous surface that exists on a mesh bag. In these disclosed devices, once the opposing sides of the plastic bag are separated from each other, each side is held by clamps and the bag is filled with produce. After the filling step is completed, the back or second side of the filled bag is ripped from the wicket that holds it. These disclosed devices would not function effectively with mesh backs because the mesh filaments are not easily ripped or torn. The filaments can be selectively weakened between the wicket holes and the top edge, but this process is expensive. Thus, these devices as disclosed are not viable for use with mesh bags. Accordingly, there is a need for automatic bagging systems that can be used with mesh bags.

There have been attempts in the prior art to open and dispense products into mesh bags in an automatic bagging apparatus, such as in U.S. Pat. No. 4,644,735. The disclosed apparatus opens the bag and then pulls the sides of the bag so that the single filament holding the bag onto a wicket is cut by a razor disposed at one end of the wicket. The disclosed apparatus is complex and expensive. Another problem is that there can only be one filament that holds the second side of the bag onto the wicket. It is expensive to load mesh bags onto wicket pins to ensure this single filament requirement is satisfied. The razors also become dull. Once the razors cut the single filament, the second side is described as being forced onto a surface to which it is clamped. The possibility arises that the clamp will not connect to hold the second side of the bag, which would cause production delays and other problems. Moreover, operation of this bag opening device is slow, which decreases efficiency, productivity, and the desirability of this device. Likewise, the complexity of this apparatus increases both its purchase and operation costs.

Therefore, a need exists in the art for an apparatus that rapidly opens mesh bags so that these bags can effectively be used in production plants. An associated need is that the apparatus is affordable. Furthermore, it is desired that the machines be reliable and relatively non-complex.

Still another need in the art is to remove opened wicketed bags, including both mesh bags and plastic bags, without ripping the bags from their wicket pin. Ripping or tearing a bag from a wicket creates strain on both the wicket and the bag. It is also desired that a random number of filaments can be disposed over a wicket pin because of the expense in loading the bags as well as the possibility of the bags prematurely being removed from the wicket.

SUMMARY OF THE INVENTION

The present invention satisfies these and other needs in the art. In the preferred embodiment, the present invention encompasses a method and apparatus for opening a bag, specifically a mesh bag. The apparatus comprises a frame, a bag holding means, such as a wicket, disposed on the frame for supporting the mesh bag, a first clamp disposed on the frame adjacent the forward end of the bag holding means, at least one second clamp, which is used for opening more than one bag, disposed on the frame adjacent the first clamp, an air dam slidably mounted to the frame, an opener clamp slidably mounted to the frame, and a means for directing a pressurized fluid through at least a portion of the open end of the first side of the outermost mesh bag adjacent its open end and onto the air dam.

In operation, the first clamp is placed in contact with the outermost mesh bag on the bag holding means. The air dam is then located adjacent the open end of the first side of the outermost mesh bag so that the pressurized fluid is directed through at least a portion of the open end of the first side of the outermost mesh bag adjacent its open end and onto the air dam. This causes the portion of the mesh bag through which the pressurized fluid is directed to move toward the air dam and the opener clamp is moved to grasp it. The air dam and opener clamp are moved away from the outermost mesh bag so that the outermost mesh bag is opened by the opener clamp grasping its first side and the first clamp holding its second side. The open bag can then be filled with produce or other desired product.

If there are a plurality of bags on the bag holding means that are being urged toward its forward end, then the second clamp is used to prevent the remaining bags from falling off of the bag holding means when the first clamp is open to release the outermost bag. The second clamp is movable between a grasp position and a free position. In the grasp position the second clamp contacts a different portion of the outermost mesh bag than that contacted by the first clamp or, alternately, a portion of the mesh bag adjacent the outermost mesh bag after that portion of the outermost mesh bag is partially pulled away from the bag holding means when it is pulled open by the opener clamp.

After the second clamp is in position to hold the bags behind the outermost bag, the open bag is clamped adjacent one of its edges with a take-away clamp. Then, the first clamp releases the second side of the opened bag so that the second side of the opened bag is removed from the bag removal means. The bag slides off the end of the bag holding means without ripping the bag. The opener clamp also moves to its release position so that the take-away clamp is the only clamp gripping the bag. The opened bag can then be removed by the take-away clamp to a bag closing location, preferably concurrently supported on a conveyor disposed beneath the bag that moves synchronously with the take-away clamp.

The first clamp is then repositioned to be in contact with the same mesh bag that the second clamp contacts, which is now the outermost mesh and the second clamp is moved away from the outermost mesh bag so that it is removed from the outermost mesh bag. The process then repeats itself until all of the bags on the bag holding means are opened.

The present invention also comprises more than one bag holding means so that when one is emptied, another is positioned adjacent the first and second clamps having bags predisposed on it to ensure continuity of packaging operations.

These and other aspects of the present invention are discussed more fully in the Description of the Invention below and shown in the Figures.

DETAILED DESCRIPTION OF THE INVENTION

Figure 1:
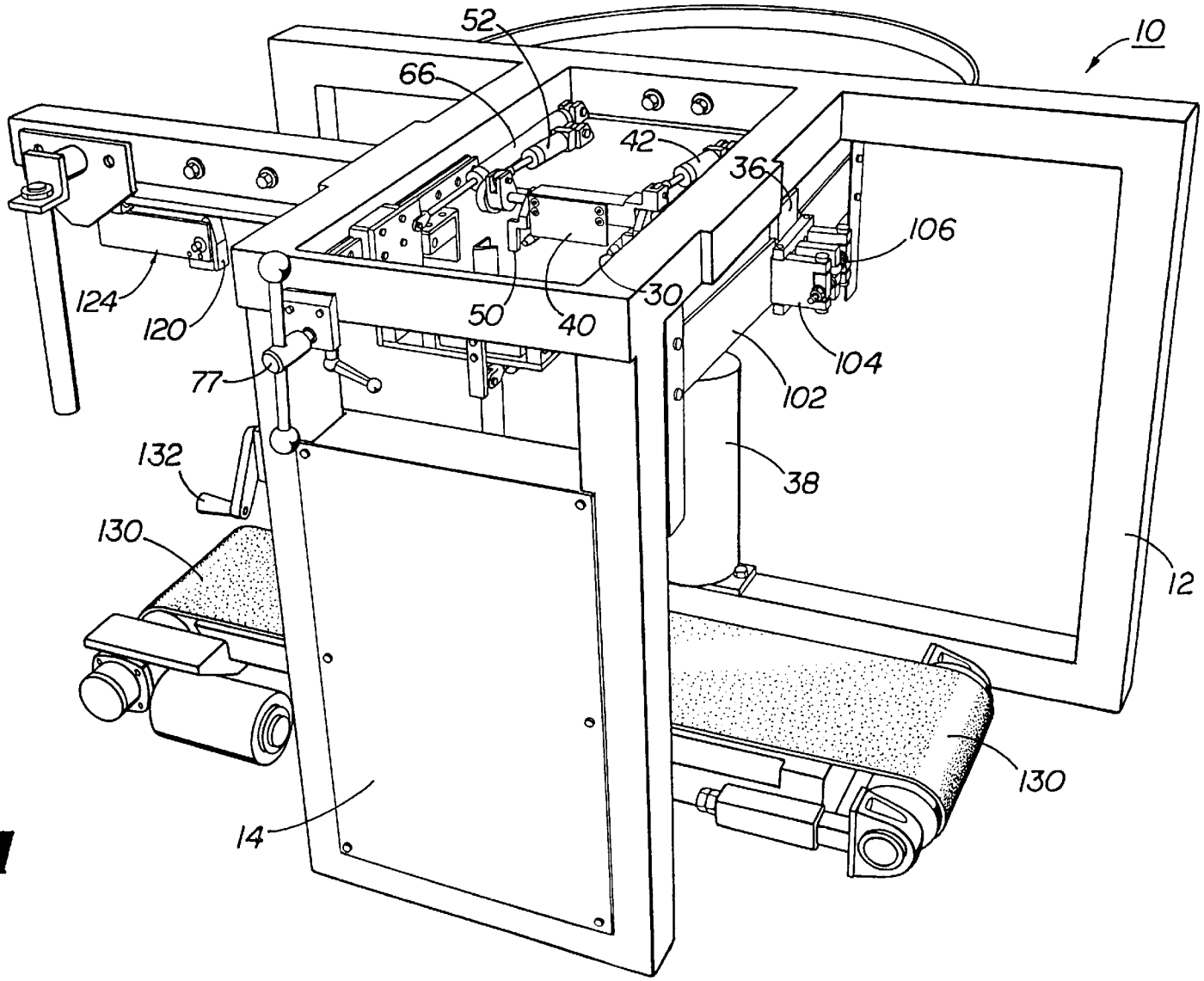
FIG. 1 is a perspective view of the preferred embodiment of the present invention.

The present invention is more particularly described in the following examples which are intended as illustrative only since numerous modifications and variations therein will be apparent to those skilled in the art. As used in the specification and in the claims, "a" can mean one or more, depending upon the context in which it is used.

The preferred embodiment of an automatic bag opening apparatus 10 for opening mesh bags 20 is shown in FIGS. 1–4. Referring to these Figures, the bag opening apparatus 10 can open a single bag 20 or, more preferably, sequentially open a plurality of mesh bags 20. The open bags can be used, for example, in packaging produce, such as potatoes, oranges, lemons, onions, garlic, and the like. Mesh bags can encompass all types of porous bags, including conventional mesh bags made from filaments as well as plastic bags that are have a plurality of holes to allow the products to aerate and breathe, e.g., plastic bags used to package potatoes. Each bag 20 has a first side 22, a second side 23, two opposing edges 24, a closed end 26, and an opposite open end 28. The forward most mesh bag 20 on the bag opening apparatus 20 is the outermost mesh bag 29. As shown for the preferred embodiment, the length between the closed end 26 and the open end 28 of the first side 22 of the mesh bag 20 is shorter than for the second side 23.

The bag opening apparatus 10 of the present invention comprises a frame 12, a bag holding means 30 disposed on the frame 12 having a forward end 32 and an opposite back end 33, a first clamp 40 disposed on the frame 12 adjacent the forward end 32 of the bag holding means 30, an air dam 60 slidably mounted to the frame 12, and a means 68 for directing a pressurized fluid through at least a portion of the open end 29 of the first side 22 of the outermost mesh bag 29 and onto the air dam 60. The bag opening apparatus 10 preferably further comprises a control system 14 for coordinating its movements and a second clamp 50 disposed on the frame 12 adjacent the forward end 32 of the bag holding means 30 for when the bag opening apparatus sequentially opens more than one bag 20.

The bag holding means 30 supports at least a portion of the second side 23 of the mesh bags 20. In the preferred embodiment, the mesh bags 20 are wicketed and the bag holding means 30 comprises a wicket 34. More specifically, referring to FIG. 7, the wicket 34 comprises a wicket support unit 36 rotatably mounted to the frame 12, a plurality of wickets 34 fixedly attached to the wicket support unit 36, and a means for rotating the wicket support unit 38. The wicket rotating means 38 rotates so that the forward end 32 of each wicket 34 may be selectively disposed adjacent the first clamp 40 and second clamp 50. Thus, when no mesh bags 20 are disposed on the wicket 34 adjacent the first and second clamps 40, 50, the wicket rotating means 38 then rotates the wickets 34 so that another wicket 34 is aligned adjacent the first and second clamps 40, 50. This allows a semi-continuous operation as opposed to stopping and reloading a single wicket 34 with bags 20. With the present invention, once one wicket 34 is emptied and another rotated into place for use, the emptied wicket 34 can be reloaded with mesh bags 20 without affecting the production rates.

The present invention may further comprise a sensing means 39 for communicating to the wicket rotating means 38, preferably electrically via the control system 14, when no mesh bags 20 are disposed on the wicket 34 adjacent the first and second clamps 40, 50. The signal from the sensing means 39 causes the wicket rotating means 38 to rotate the wicket support unit 36 so that another wicket 34, which has bags 20 predisposed on it, is aligned adjacent the first and second clamps 40, 50 for continuity of production operation. The sensing means 39 may be a photoelectric eye, microswitch, or other detector known in the art for this purpose.

The wicket support unit rotating means 38 preferably is pneumatically driven, similar to the other components of the bag opening apparatus 10. That is, a differential pressure is applied to the wicket support unit 36 so that it causes the unit 36 to rotate. This may be achieved by bleeding off the pressure in one or more selected chambers on one side of the wicket support unit 36 or by increasing the pressure in one or more selected opposing chambers, thereby causing rotation. However, since the applied differential pressure to the wicket support unit 36 can cause a rapid acceleration and resulting high angular velocity of the wickets 34, it has been found that a hydraulic damping system is desirable to limit the angular velocity. The hydraulic damping system can be an aqueous fluid, such as hydraulic fluid or other non-corrosive fluid, disposed at the lower end of the wicket support unit 36. The lower end of the wicket support unit 36 is flared out into vanes that interact with the aqueous fluid so that the fluid dampens the speed of movement of the wickets 34. Other wicket rotating means contemplated include an electric motor or an air gear motor.

Figure 7:
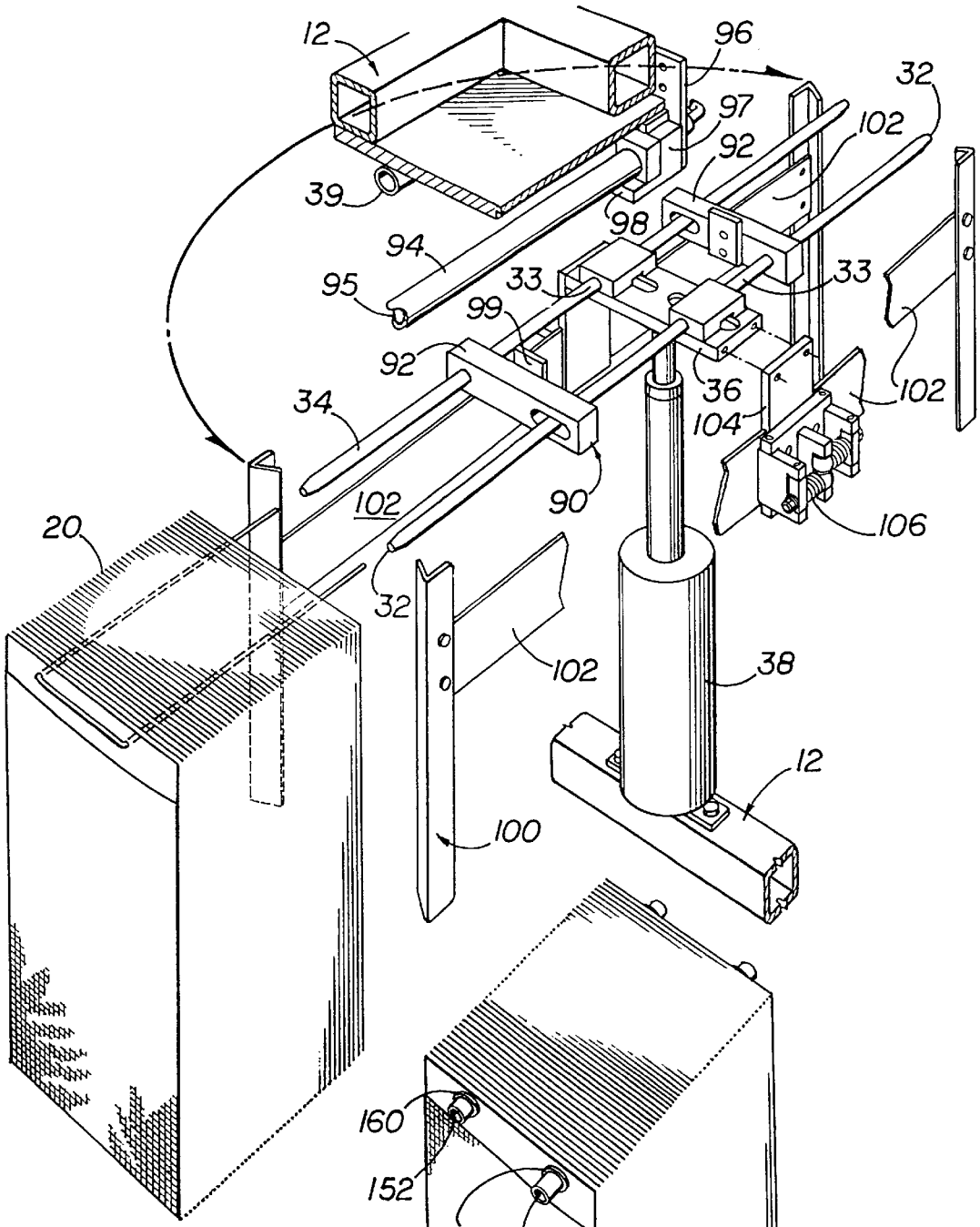
FIG. 7 is an exploded perspective view showing the bag holding means comprising multiple wickets that are rotatable to ensure continuity of operation.

The wicket support unit 36, shown in FIG. 7, has two wickets 34 disposed on it so that the wicket rotating means rotates the wicket support unit 180° to align the other wicket 34 with the first and second clamps 40, 50. In addition, other embodiments are contemplated. For example, an alternative embodiment is a wicket support unit 36 that has four wickets 34 disposed on it so that the wicket support unit rotates 90° each time.

Figure 3:
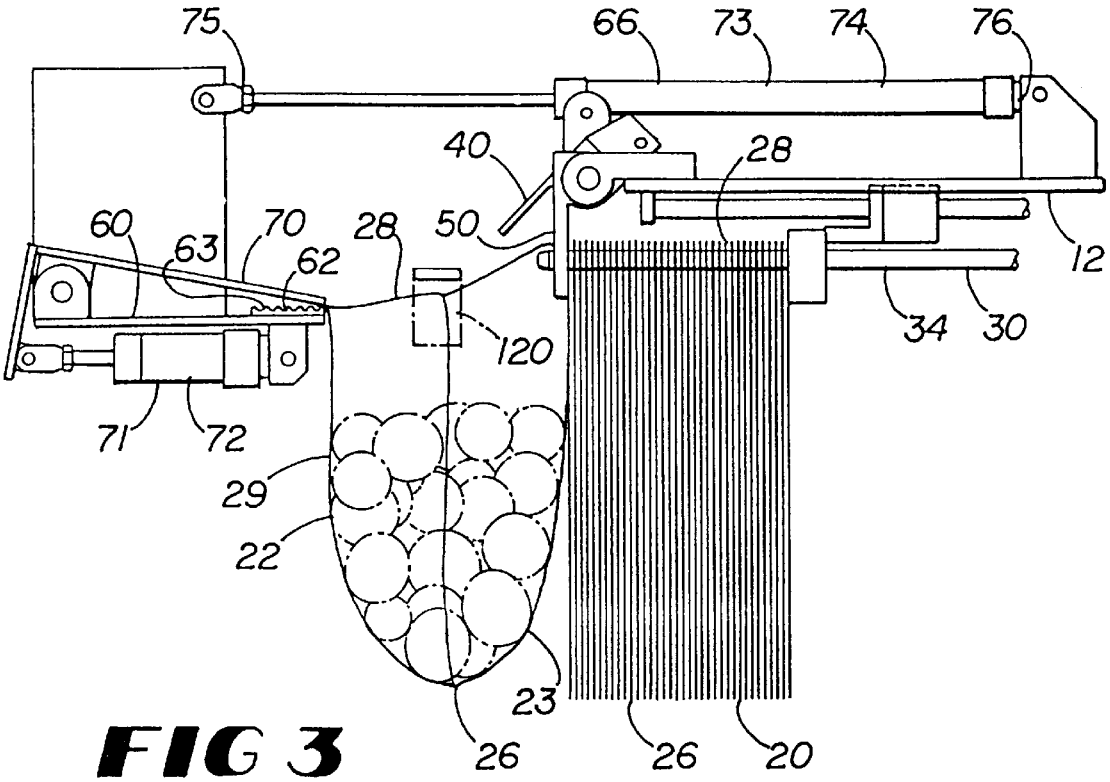
FIG. 3 is side elevational view of FIG. 2 after the opener clamp has grasped a portion of the outermost bag and moved away from the other bags to open the bag, allowing the produce to be disposed therein as shown.
Figure 3A:
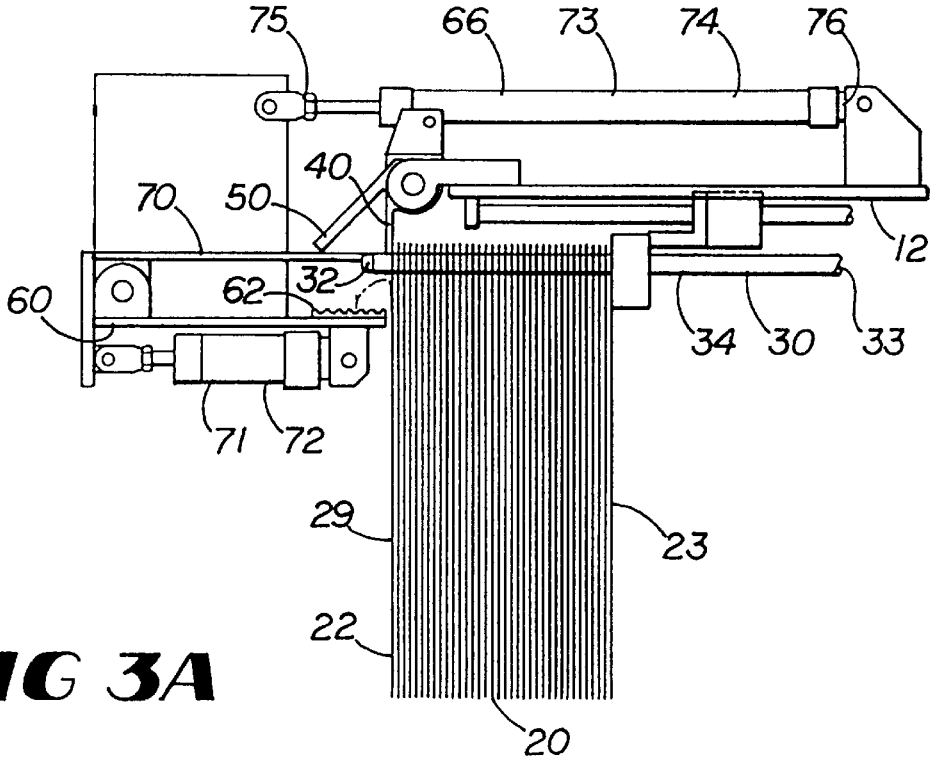
FIG. 3A is a side elevational view of FIG. 2A.
Figure 4:
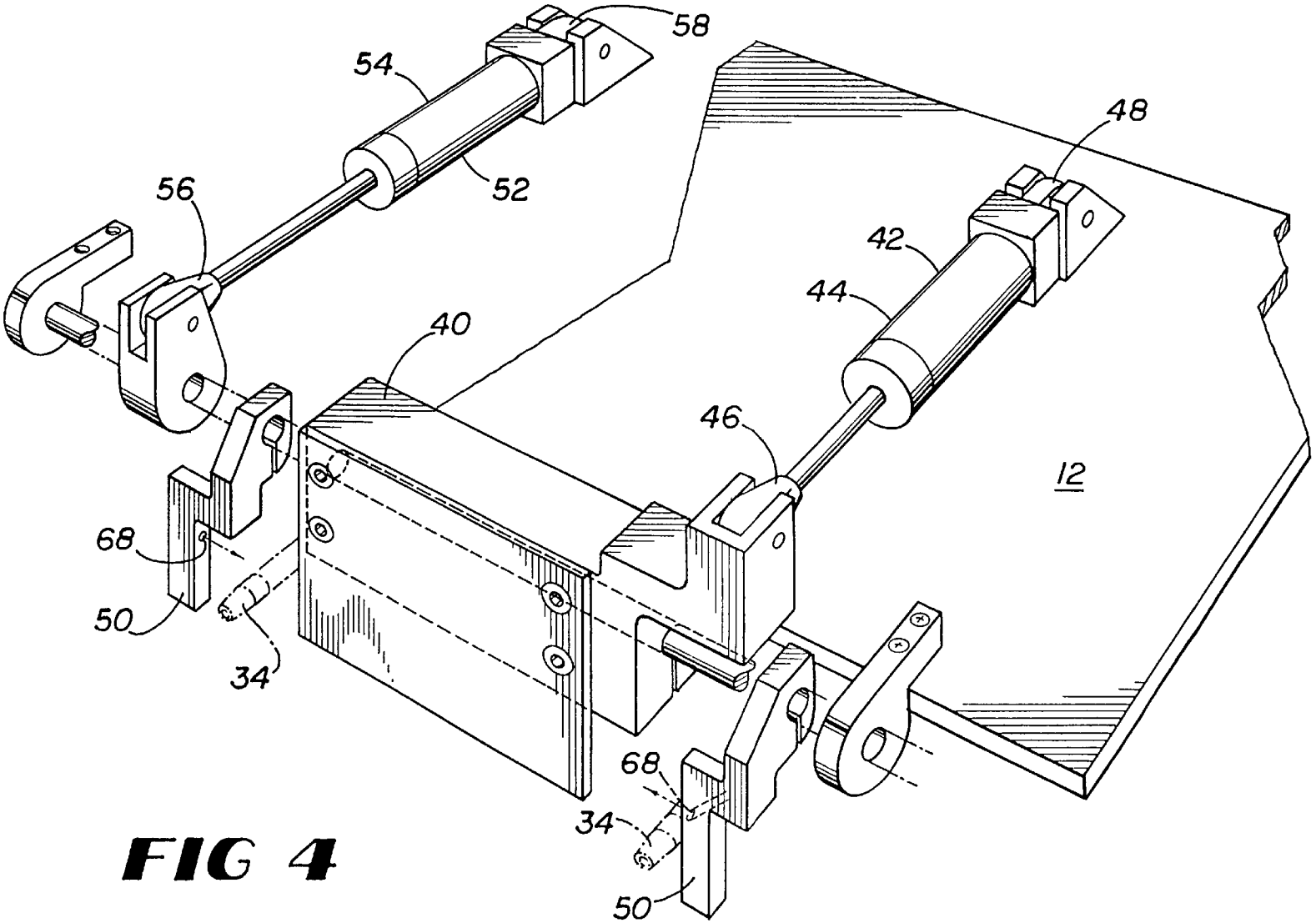
FIG. 4 is an exploded perspective view of the first and second clamps.

As best shown in FIG. 4, the first, or center, clamp 40 is disposed on the frame 12 adjacent the forward end 32 of the bag holding means 34, The first clamp 40 is movable between a hold position, in which the first clamp 40 contacts a portion of the outermost mesh bag 29, and a release position. The present invention includes a means 42 for moving the first clamp 40 between these positions. The hold position is shown in FIGS. 2, 2A, 3A, and 4 and the release position is illustrated in FIG. 3. In the preferred embodiment, the moving means 42 is a pneumatic cylinder 44 having a front end 46 connected to the first clamp 40 and an opposite back end 48 connect to the frame 12. However, other moving means known in the art can be used, such as hydraulic cylinders, solenoids, electric switches, and the like. These moving means are also viable alternatives for other moving means and sliding means discussed herein.

Still referring to FIG. 4, the second, or side, clamp 50 is also disposed on the frame 12 adjacent the forward end 32 of the bag holding means 30. In the preferred embodiment, there are two second clamps 50 to ensure that no portion of the bags 20 on the bag holding means 30 inadvertently or prematurely removed. The second clamp 50 is movable between a grasp position and a free position. The free position is shown in FIGS. 2A and 3A. In the grasp position, the second clamp 50 contacts a different portion of the outermost mesh bag 29 than that contacted by the first clamp 40, as shown in FIG. 2, or, alternately, a portion of the mesh bag 20 adjacent the outermost mesh bag 29 after that portion of the outermost mesh bag 29 is partially pulled away from the bag holding means 30 when the second clamp 50 is in the free position, as shown in FIG. 3.

The present invention also includes a means 52 for moving the second clamp 50 between the grasp and free positions. As with the first clamp 40, the moving means 42 in the preferred embodiment is a pneumatic cylinder 54 having a front end 56 connected to the second clamp 50 and an opposite back end 58 connect to the frame 12. Since the second clamp is to retain the bags 20 on the bag holding means 30 other than the outermost bag 29 which is held by the first clamp 40, other devices may satisfy this function. In fact, the other devices do not need to be a clamp, such as a retaining bar disposed at the lower end of the bags 20 disposed on the bag holding means 30 or the like. Likewise, the second clamp 50 can be located at other positions and still serve the same function.

Figure 2:
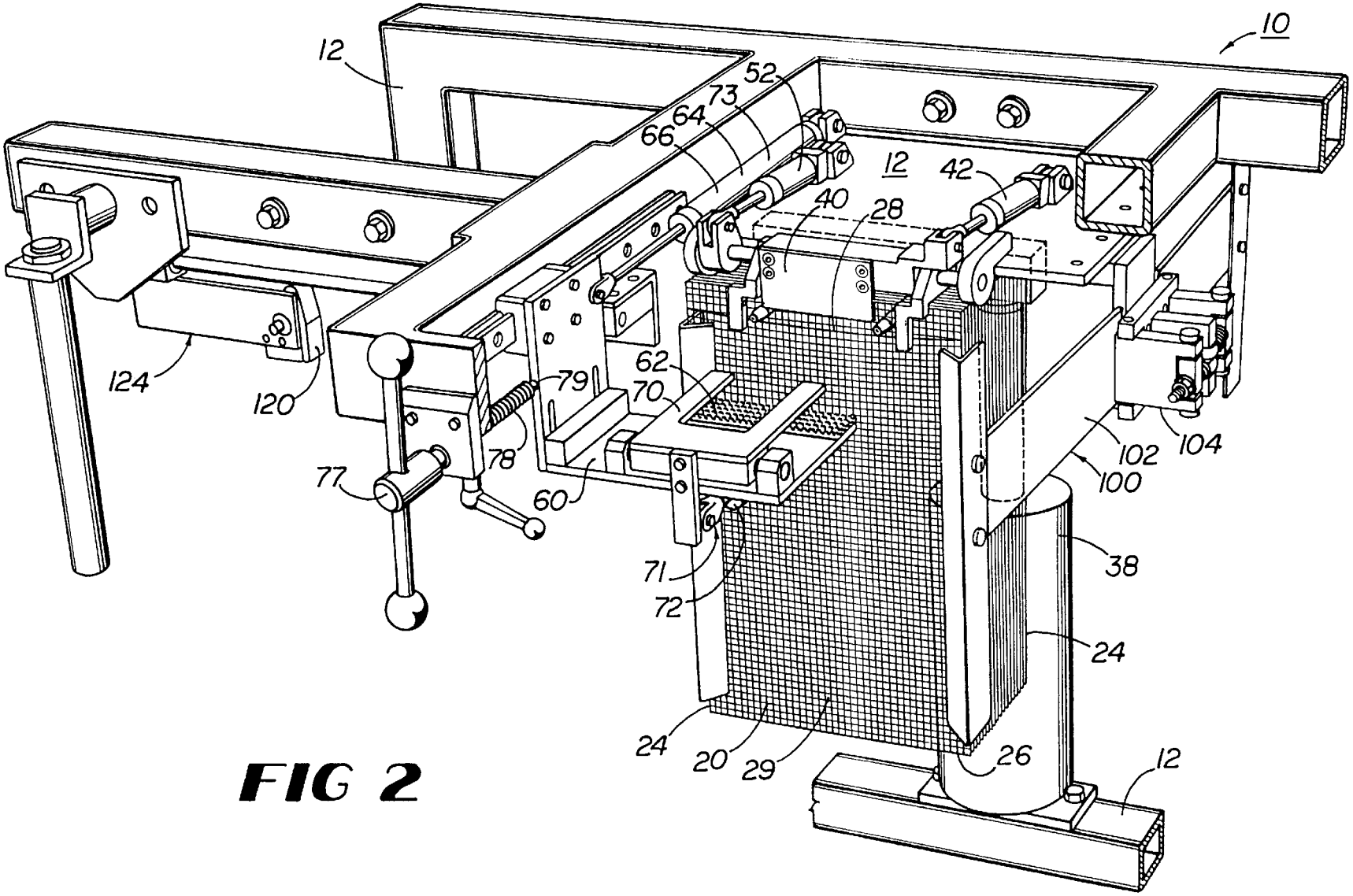
FIG. 2 is an enlarged view of a portion of FIG. 1 that shows the bag opening components.
Figure 2A:
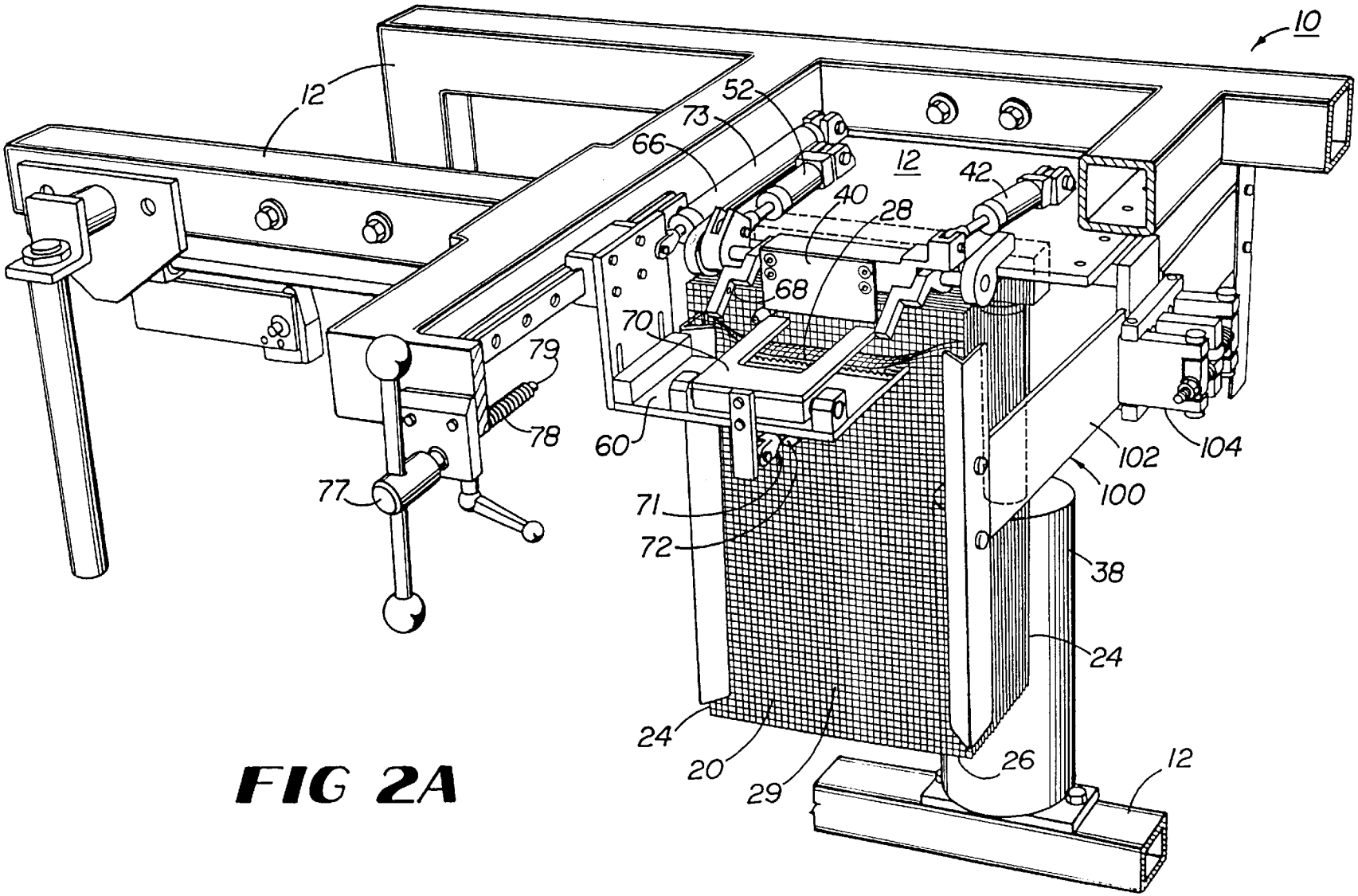
FIG. 2A is a view of FIG. 2 in which the air dam and opener clamp have moved to the outermost bag and a pressurized fluid is directed through a portion of the outermost bag and onto the air dam which causes that portion of the bag to move so that the opener clamp can grasp it.

The air dam 60, which is slidably mounted to the frame, is shown in FIGS. 2–3A. The bag opening apparatus 10 includes a means 64 for sliding the air dam 60 between an opening position adjacent the open end 28 of the first side 20 of the outermost mesh bag 29 and a removed position. The opening position is shown in FIGS. 2A and 3A and the removed position is shown in FIGS. 2 and 3. The air dam 60 preferably further comprises a mat 62 having a textured upper surface 63 and being disposed on the air dam 60 so that the pressurized fluid is directed through the portion the outermost mesh bag 29 and onto the upper surface 63 of the mat 62. The upper surface 63 of the mat 62 interfaces with the mesh material of the bag to help ensure that there is no slippage between the surfaces.

The opener clamp 70, which is also slidably mounted to the frame 12, is movable between a closed position, in which the opener clamp 70 clamps at least a portion of the first side 22 of the outermost bag 29, and an open position. The closed position is shown in FIGS. 2, 2A, and 3 and the open position in FIG. 3A. Accordingly, the bag opening apparatus 10 also includes a means 71 for moving the opener clamp between the open and closed positions. The opener clamp moving means 71 is best shown in FIGS. 3 and 3A. Similar to the first and second clamps 40, 50, the preferred embodiment of the moving means 71 is a pneumatic cylinder 72 and, similarly, other moving means known in the art, such as hydraulic cylinders, solenoids, electric switches, and the like, can be used.

The bag opening apparatus 10 also includes a means 73 for sliding the opener clamp 70 between a first position at a first desired distance from the outermost mesh bag 29 to grasp its first side 22, which is shown in FIGS. 2A and 3A, and a second position at a second desired distance from the outermost mesh bag 29 to pull the first side 22 of the outermost mesh bag 29 away from its second side 23, which is shown in FIGS. 2 and 3. Preferably, opener clamp sliding means 73 comprises a pneumatic cylinder 74 having a front end 75 attached adjacent the opener clamp 70 and an opposite rear end 76 disposed on the frame 12 adjacent the back end 33 of the bag holding means 30. As one skilled in the art will appreciate, the connection points of the pneumatic cylinders discussed for the preferred embodiment can have other points of contact and perform the same functions.

The sliding means 73 can further comprise an adjustable motion limiter means 77 for stopping the sliding motion of the opener clamp 70 at the second desired distance from the outermost mesh bag 29. The adjustable motion limiter means 77, shown best in FIGS. 2 and 2A, comprises a stop screw 78 adjustably mounted to the frame 12. Also in the preferred embodiment, a hydraulic tip 79 is used to buffer the motion of the opener clamp at the second desired distance from the outermost mesh bag 29. The pneumatic cylinder 74 is thus adaptable to open mesh bags 20 of different sizes by varying the setting of the stop screw 78, e.g., moving the hydraulic tip 79 toward the outermost mesh bag 29 for a smaller bag size, thereby varying the second desired distance. The adjustable motion limiter means 77 can comprise other embodiments including, for example, a variable expansion cylinder.

As shown in the Figures, the air dam 60 and the opener clamp 70 are an integral unit so that the air dam 60 is a clamping surface of the opener clamp 70 in the preferred embodiment. Thus, the air dam sliding means 64 that operates between the opening position and the removed position is the same as the opener clamp sliding means 73 that operates between the first position and the second position, wherein the opening position is the same as the first position and the removed position is the same as the second position.

When the air dam 60 is at its opening position, the pressurized fluid directing means 68 directs the pressurized fluid, such as, for example, compressed air or other gas, through at least a portion of the first side 22 of the outermost mesh bag 29 adjacent its open end 28 and onto the air dam 60. This causes the portion of the mesh bag 29 through which the pressurized fluid is directed to move toward the air dam 60 so that the opener clamp 70 may grasp a portion of the first side 22 of the bag 29. For example, an air pressure of eighty pounds per square inch gauge is effective to accomplish the opening of the bag.

The pressurized fluid directing means 68 can be disposed at various locations so that it directs the fluid to move the top end of the first side of the outermost bag 29 downwardly. In the preferred embodiment, there are two pressurized fluid directing means 68 each is disposed above a respective second clamp 50 and downwardly directed onto the first side 22 of the outermost bag 29. As shown in FIGS. 2A and 4, an alternate embodiment disposes the pressurized fluid directing means 68 within the second clamp 50. The advantage of this embodiment is that a cut-off valve can be disposed within the second clamp 50. That is, when the second clamp 50 is in the grasp position, as shown in FIG. 2, the internal valve cuts off the flow of pressurized fluid and when the second clamp 50 is in the free position, as shown in FIG. 2A, the repositioning of the clamp opens the internal valve to allow flow of the pressurized fluid. Another embodiment may dispose the fluid directing means 68 within the tips of the upper member of the opener clamp 70.

It is believed that the air dam 60 creates a turbulence and corresponding low pressure area on the air dam 60 as the pressurized fluid interfaces with and is redirected by it. The resultant fluid dynamics at the air dam 60, in conjunction with the pressurized fluid traversing through the first side 22 of the bag 20, causes the first side 22 to separate from the second side 23 of the bag 20. When the first side 22 is separated from the second side 23 of the bag 20, the opening clamp 70 is then able to clamp the first side 22 to open the bag 20.

The method of automatically opening at least one mesh bag 20 using the present invention thus comprises the steps of providing at least one mesh bag 20 on the bag holding means 30 and positioning the first clamp 40 in contact with the outermost mesh bag 29, which is shown in FIG. 2. Referring to FIGS. 2A and 3A, the next steps entail locating the air dam 60 adjacent the open end 28 of the first side 22 of the outermost mesh bag 29, directing the pressurized fluid through at least a portion of the open end 28 of the first side 22 of the outermost mesh bag 29 and onto the air dam 60. The pressurized fluid causes the portion of the mesh bag 29 through which it is directed to move toward the air dam 60. Now referring to FIG. 3, the method of the present invention entails moving an opener clamp 70 to grasp that portion of the first side 22 of the outermost bag 29 that the pressurized fluid moved toward the air dam 60, repositioning both the air dam 60 and the opener clamp 70 a desired distance away from the forward end 33 of the bag holding means 30. Thus, the outermost mesh bag 29 is opened by the opener clamp 70, grasping its first side 22, and the first clamp 40 holding its second side 23. At this step, a predetermined material can be placed in the opened bag, e.g., produce, by any means known in the art, such as a funnel disposed over the open bag, the packing apparatus disclosed in U.S. Pat. No. 4,541,228 issued to Peterson (which is hereby incorporated by reference), and the like. FIG. 3 shows the open bag after produce has been added.

Figure 5:
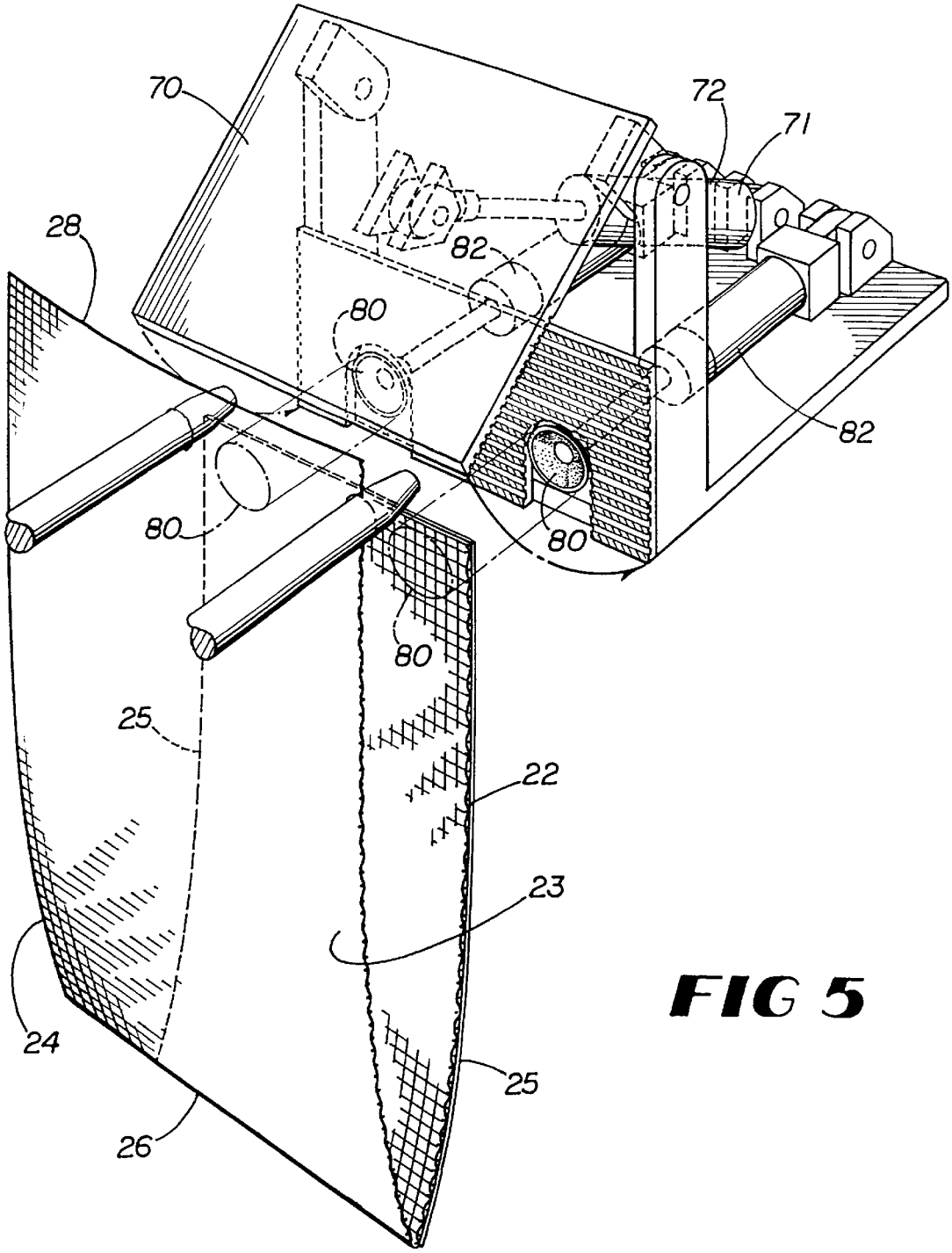
FIG. 5 is a perspective view of an alternative embodiment of the present invention that uses vacuum cups instead of a pressurized fluid and an air dam combination to separate the sides of the bag.

In an alternative embodiment shown in FIG. 5, the bag opening apparatus 10 does not use the air dam 60 and the pressurized fluid directing means 68, but, instead, uses at least one movable vacuum cup 80. This embodiment of the present invention requires bags 20 in which their the first sides 22 have at least a portion adapted to interface with a vacuum cup 80, such portion preferably being a label 25. Although a bag 20 having a label 25 on it can be used in the preferred bag opening apparatus 10 having an air dam 60, it is not necessary. An important consideration from a commercial perspective is that the label 25 is an expensive component of a mesh bag.

The alternative embodiment of the bag opening apparatus 10 specifically includes at least one vacuum cup 80 slidably mounted to the frame 12, a means 82 for sliding the vacuum cup between an opening position adjacent the open end of the first side 22 of the outermost bag 29 and a removed position, and a means for separating the first and second sides 22, 23 of the outermost bag 29 by creating a suction in the vacuum cup 80 when it is adjacent the label 25 and by then moving the vacuum cup 80 away from the second side 23 of the bag 20. After separation, the operation of this embodiment is similar to that of the preferred embodiment in which the opener clamp 70, which is vertically disposed as shown in FIG. 5, moves to a closed position to clamp at least a portion of the first side 22 of the outermost bag 29. This allows the outermost bag 29 to be opened by the opener clamp 70 sliding to the second desired distance from the outermost bag 29 as the opener clamp 70 holds the first side 22 and the first clamp 40 holds a portion of the second side 23. As one skilled in the art will appreciate, other steps in the method of opening a bag 20 are similar to that of the preferred embodiment discussed herein.

The bag opening apparatus 10 of the present invention can further comprise a means 90 for advancing the mesh bags 20 toward the forward end 32 of the bag holding means 30, or wicket 34, from its back end 33. Referring back to FIG. 7, the bag advancing means 90 comprises a bag advancer 92 adapted to be disposed on the wicket 34 and at least one pneumatic cylinder 94 for directing the bag advancer 92 toward the forward end 32 of the wicket 34. The pneumatic cylinder 94 may have a front end 95 connected to the bag advancer 92 and an opposite rear end 96 disposed adjacent the back end 33 of the wicket 34. The bag advancer 92 is preferably adapted so that the wicket 34 can be adjusted to accept bags 20 that are wicketed to different widths.

As shown in FIG. 7, the cylinder 94 is a rodless pneumatic cylinder in which the piston 97 connects with bag advancer 92 and pushes it forward, which thus advances the bags 20 toward the forward end of the wicket 34 so that they can be sequentially opened. After all of the bags 20 have been opened, the piston 97 is withdrawn to the back end 33 of the wicket 34. It is advantageous to move the bag advancer 92 to the back end 33 also. The embodiment shown in FIG. 7 allows this movement by having a magnet 98 or similar component disposed on the piston 97 and a ferrous material 99 disposed on the bag advancer 92. Thus, as the piston 97 is moved to the back end 33, the bag advancer 92 follows it until the piston 97 is over the wicket support unit 36. It is preferred that the piston 97 be in the center of the wicket support unit 36, so that when it rotates by the wicket rotating means 38, the piston 97 does not interfere. It is also desired that the force between the magnet 98 and the ferrous material 99 be greater than that of the centrifugal force created by the wicket rotating means 38 so that the bag advancer 92 remains adjacent to the back end 33 of the wicket 34 throughout the rotation.

Referring again to FIGS. 2, 2A, and 7, the bag opening apparatus 10 further comprises a bag retaining means 100 for aligning the edges 24 of the mesh bags 20 disposed on the bag holding means 30, or the wicket 34. The bag retaining means preferably comprises two longitudinally-extending bag guides 102 downwardly depending from the wicket support unit 36 and oriented substantially parallel to the wicket 34. Each bag guide 102 aligns a respective edge 24 of the mesh bags 20 disposed on the wicket 34. Each bag guide 102 preferably is laterally adjustable, which allows different sized bags 20 to be disposed from the wicket 34 and aligned by the bag guides 102. As shown in FIG. 7, each bag guide 102 is coupled to the wicket support unit 36 by a hinge 104. The hinge 104 allows the bag guide 102 to move away from the wicket 34 and it is biased to align the bag guide substantially parallel to the wicket 34. The hinge 104 may be biased by a spring 106. The bag guides 102 are particularly useful in the preferred embodiment that uses multiple wickets 34 and a wicket rotating means 38.

After the present invention opens the outermost bag 29, another inventive aspect of the invention encompasses removing the bag from the wicket 34 without ripping or tearing it. This aspect is advantageous because mesh bags are difficult to rip or tear, even with a razor which dulls over time. Ripping a bag from a wicket also puts a stress on the wicket and the bag. Furthermore, torn bags are less sightly to consumers.

Assuming that there are a plurality of bags 20 to be opened, an initial step, after moving the opener clamp 70 to the second desired position, is positioning the second clamp 50 in contact with a portion of the mesh bag 20 adjacent the outermost mesh bag 29. Positioning the second clamp 50 is facilitated because the outermost mesh bag 29 has been partially pulled away from the bag holding means 30 which allows placement of the second clamp 50 at this position without contacting the outermost bag 29.

Figure 6:
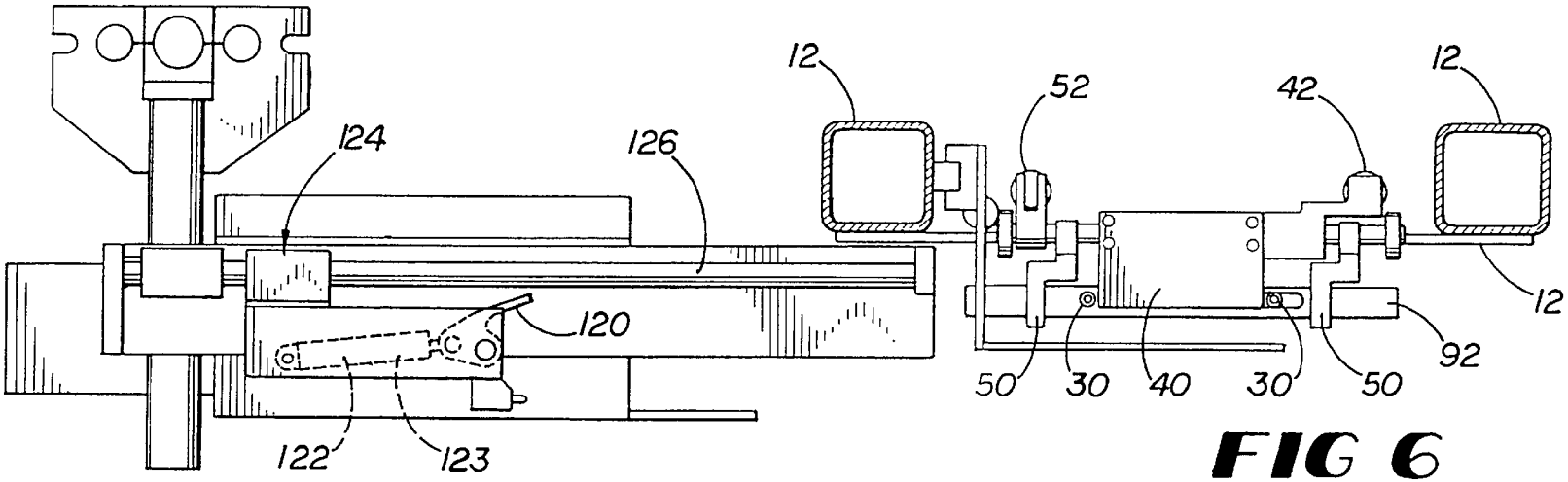
FIG. 6 is a side elevational view of a portion of the present invention showing the take-away clamp located at the bag closing station.
Figure 6A:
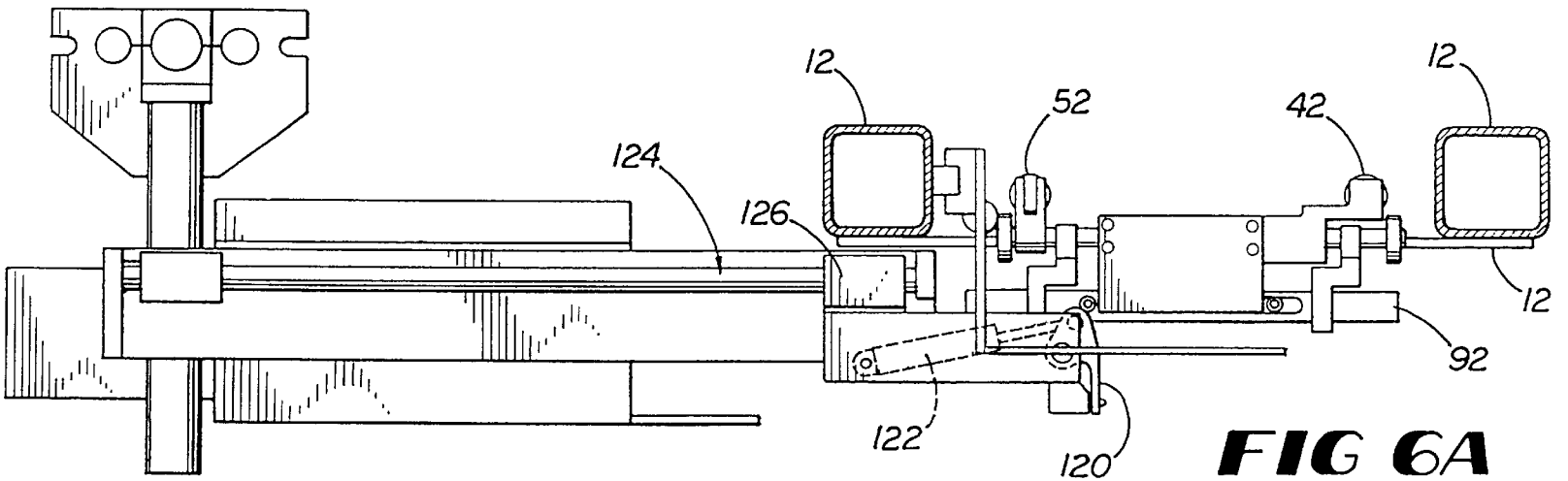
FIG. 6A is a side elevational view of FIG. 6 in which the take-away clamp is grasping the open bag.

Referring now to FIGS. 3, 6, and 6A, the present invention encompasses a take-away clamp 120 disposed between the first clamp 40 and the opener clamp 70 when the opener clamp 70 is positioned at the second desired distance from the outermost mesh bag 29. The take-away clamp 120 is movable between an attach position in which the take-away clamp 120 clamps at least a portion of the opened outermost mesh bag 29, as shown in FIG. 6*a*, and a release position, shown in FIG. 6. There is also a means 122 for moving the take-away clamp 120 between the attach position and the release position, which is preferably a pneumatic cylinder 123.

The present invention also encompasses a means 124 for conveying the take-away clamp 120 between an opening location and a bag closing location. In the preferred embodiment, the take-away clamp conveying means 124 is a pneumatic rodless cylinder 126. The take-away clamp 120 is shown at the opening location in FIG. 6A and at the bag closing location in FIG. 6. At the bag closing station, any mechanism known in the art that closes the top of the bag 20 that has been filled with a desired product may be used. Since this aspect of the apparatus forms no part of the present invention, the closing mechanism is not shown.

To assist the take-away clamp conveying means 124, the present invention further comprises a conveyor 130 disposed below the closed end 26 of the outermost mesh bag 29. Referring back to FIG. 1, the conveyor 130 is adjustable in height by a handle 132 that can mechanically vary the elevation to accommodate bags of different dimensions and so that the conveyor 130 supports the closed end 26 and the products disposed in the bag 29. The conveyor 130 moves synchronously with the take-away clamp 120.

In operation, the opened mesh bag 29 is clamped adjacent one of its edges 24 with the take-away clamp 120. Then, after the step of positioning the second clamp 50, first clamp 40 is positioned to release the second side 23 of the opened bag 29, which is shown in FIG. 3. When the first clamp 40 releases the bag 29, the second side 23 of the opened bag 29 is removed from the bag removal means 30 as a result of the tension that the bag 29 experiences from the opening clamp 70 being at the second desired position and the weight of the product disposed within the bag 29. The opener clamp 70 then releases the first side 22 of the opened bag 29 so that only the take-away clamp 120 is grasping the bag 29.

Thus, this aspect of the present invention of removing bags 20 without tearing or ripping them from the wicket 34 is applicable to all type of bags, including mesh bags, plastic bags and the like. To use the present invention for other types of bags, there must be a means for separating the first side 22 from the second side 23 of the bag 20. As discussed herein, the separating means can comprise an air dam 60 slidably mounted to the frame 12 and a pressurized fluid directing means 68. Similarly, in another embodiment, the separating means can comprise at least one vacuum cup 80 slidably mounted to the frame and a means 82 for sliding the vacuum cup 80 when it is adjacent the portion of the first side 22 of the bag 20 adapted to interface therewith. Other separating means known in the art can be used, such as those disclosed in U.S. Pat. No. 5,442,898, issued to Gabree et al., or U.S. Pat. Nos. 4,715,167 and 5,421,143.

After the first clamp 40 releases the open bag, the first clamp 40 is then repositioned to be in contact with the same mesh bag that the second clamp 50 contacts, which is now the outermost mesh bag 29 on the bag holding means 30. Then the second clamp 50 is moved away from the outermost mesh bag 29 to be removed from the outermost mesh bag 29. The opening process can then be repeated.

Figure 7A:
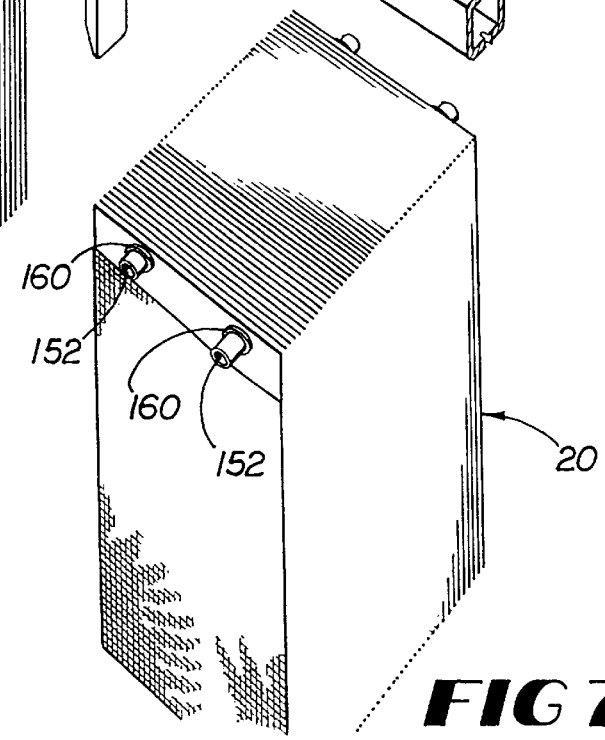
FIG. 7A is a ream of bags before being disposed on a wicket of the present invention.
Figure 8A:
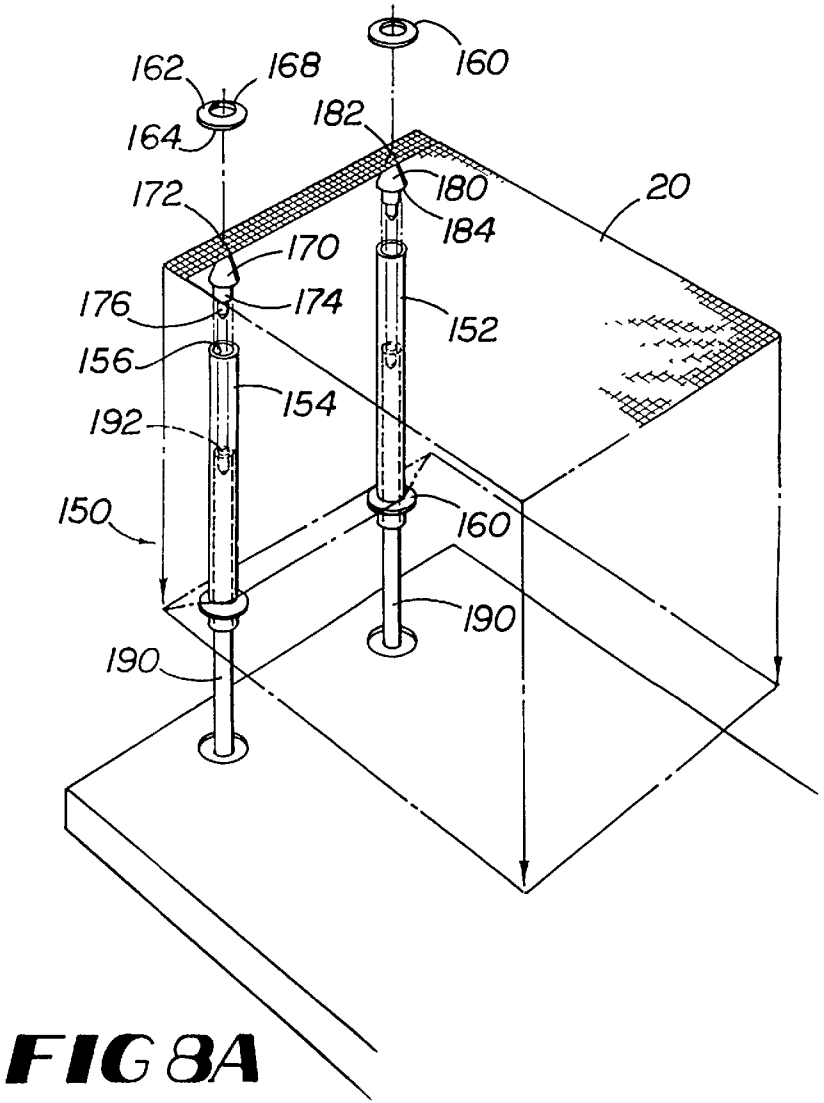
FIG. 8A shows an improved apparatus for loading bags onto a wicket.
Figure 8:
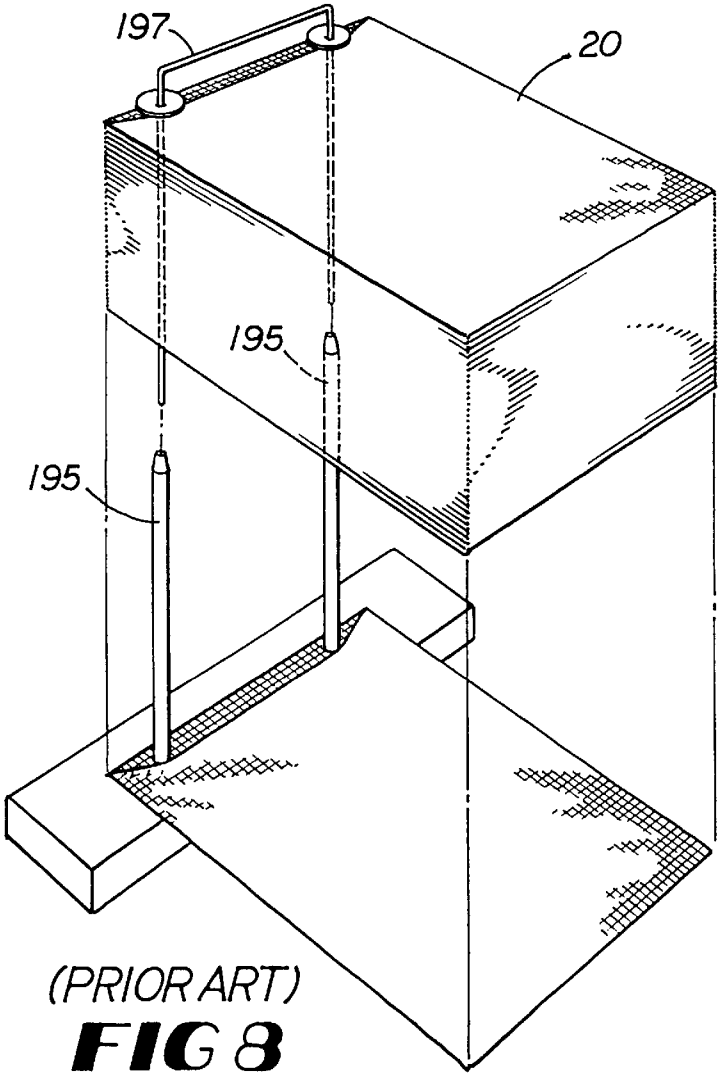
(PRIOR ART) FIG 8
FIG. 8 shows an apparatus for loading bags onto a wicket.

Another aspect of the present invention, which is shown in FIGS. 7A, 8, and 8A, is a loading apparatus 150 for loading a plurality of wicketed bags 20 onto a wicket 34. The loading apparatus 150 comprises at least one elongated loading segment 152 having an exterior surface 154 and defining a bore 156 extending longitudinally therethrough. The bore 156 is of a size to complementarily receive the wicket 34 therein. The wicketed bags 20 are disposed on the exterior surface 154 of the loading segment 152.

Preferably, each loading segment 152 further comprises a means for securing the wicketed bags thereon. The securing means comprises two elastomeric grommets 160. Each grommet has two opposing face surfaces 162, 164 and an outer edge 166. The grommet 160 also defines an opening 168 therethrough that connects the opposing face surfaces 162, 164 and having a dimension slightly less than that of the exterior surface 154 of the loading segment 152. The grommets 160 are disposed on the loading segment 160 so that they are maintained at a desired position by friction. In addition, there may be two grooves (not shown) that circumscribe the exterior surface 154 of each loading segment 152 so that the dimension of each groove is of a size to complementarily receive the opening 168 of one grommet 160 therein. The loading apparatus 150 that is ready to be loaded upon the wicket 34 is shown in FIG. 7A.

This embodiment of the present invention may further comprise a loading tip 170 to facilitate disposing bags 20 onto the loading segment 152. The loading tip 170 has a first end 172 and an opposite second end 174, which is sized to be complementarily received within the bore 156 of the loading segment 152 so that the tip 170 is detachably secured to the loading segment 152. The first end 172 of the loading tip 170 preferably comprises a conical member 180 having a pointed end 182 and an opposite wide end 184, which is the same dimension as the exterior surface 154 of the loading segment 152 so that the juncture of the conical member 180 and the loading segment 152 has a continuous transition therebetween.

It is also advantageous that each loading segment 152 further comprises a pin 190 that is complementarily received within the bore 156 of the loading segment 152. The pin 190 defines a cavity 192 therein and the loading tip 170 further comprises a protrusion 176 depending from the second end 174. The protrusion 176 is of a size to be complementarily received within the cavity 192 of the pin 190. Thus, the protrusion 176 is disposed within the cavity 192 of the pin 190 and the second end 174 of the loading tip 170 is disposed within the bore 156 of the loading segment 152.

In comparison, FIG. 8 shows an alternate loading method known in the prior art. The wicketed bags 20 are loaded onto pins 195. After loading the bags 20, a "U" shaped member 197 is disposed into the pins 195 so that the bags are transferred onto the member 197. The member 197 is then disposed onto the wicket and the bags transferred. As will be appreciated, catching of the bags occurs as the bags are transferred to the wicket 34. The loading apparatus 150 of the present invention prevents the problems associated with this conventional bag loading method.

Although the present process has been described with reference to specific details of certain embodiments thereof, it is not intended that such details should be regarded as limitations upon the scope of the invention except as and to the extent that they are included in the accompanying claims.

What is claimed is:

1. An automatic bag opening apparatus for sequentially opening a plurality of mesh bags, each mesh bag having a first side, a second side, two opposing edges, a closed end, and an opposite open end, the bag opening apparatus comprising:

a. a frame;

b. a bag holding means disposed on the frame for supporting at least a portion of the second side of the mesh bags, the bag holding means having a forward end and an opposite back end, wherein the mesh bag adjacent the forward end is the outermost mesh bag;

c. a first clamp disposed on the frame adjacent the forward end of the bag holding means, the first clamp being movable between a hold position, in which the first clamp contacts a portion of the outermost mesh bag, and a release position;

d. means for moving the first clamp between the hold position and the release position;

e. a second clamp disposed on the frame adjacent the forward end of the bag holding means, the second clamp being movable between a grasp position and a free position, wherein, in the grasp position the second clamp alternately contacts a different portion of the outermost mesh bag than that contacted by the first clamp or a portion of the mesh bag adjacent the outermost mesh bag after that portion of the outermost mesh bag is partially pulled away from the bag holding means when the second clamp is in the free position;

f. means for moving the second clamp between the grasp position and the free position;

g. an air dam slidably mounted to the frame;

h. means for sliding the air dam between an opening position adjacent the open end of the first side of the outermost mesh bag and a removed position;

i. an opener clamp slidably mounted to the frame, the opener clamp being movable between a closed position, in which the opener clamp clamps at least a portion of the first side of the outermost bag, and an open position;

j. means for sliding the opener clamp between a first position at a first desired distance from the outermost mesh bag to grasp the first side of the outermost mesh bag, and a second position at a second desired distance from the outermost mesh bag to pull the first side of the outermost mesh bag away from its second side;

k. means for moving the opener clamp between the open and closed positions; and l. means for directing a pressurized fluid through at least a portion of the first side of the outermost mesh bag adjacent its open end and onto the air dam, thereby causing the portion of the mesh bag through which the pressurized fluid is directed to move towards the air dam so that the opener clamp may grasp a portion of the first side of the outermost mesh bag.

2. The bag opening apparatus of claim 1, wherein the mesh bags are wicketed and wherein the bag holding means comprises a wicket.

3. The bag opening apparatus of claim 2, wherein the wicket comprises:

a. a wicket support unit rotatably mounted to the frame;

b. a plurality of wickets fixedly attached to the wicket support unit; and b. means for rotating the wicket support unit, wherein the wicket rotating means may be rotated so that the forward end of each wicket may be selectively disposed adjacent the first and second clamps for opening the bags.

4. The bag opening apparatus of claim 3, further comprising a sensing means for electrically communicating to the wicket rotating means when no mesh bags are disposed on the wicket adjacent the first and second clamps, wherein the wicket rotating means then rotates the wicket support unit so that another wicket is aligned adjacent the first and second clamps.

5. The bag opening apparatus of claim 1, further comprising means for advancing the mesh bags toward the forward end of the bag holding means from the back end of the bag holding means.

6. The bag opening apparatus of claim 2, further comprising means for advancing the mesh bags toward the forward end of the wicket from the back end of the wicket.

7. The bag opening apparatus of claim 6, wherein the bag advancing means comprises:

a. a bag advancer adapted to be disposed on the wicket; and b. at least one pneumatic cylinder for directing the bag advancer toward the forward end of the wicket, the pneumatic cylinder having a front end that contacts the bag advancer and an opposite rear end disposed adjacent the back end of the wicket.

8. The bag opening apparatus of claim 1, wherein the bag opening apparatus further comprises a bag retaining means for aligning the edges of the mesh bags disposed on the bag holding means.

9. The bag opening apparatus of claim 3, wherein the bag opening apparatus further comprises a bag retaining means for aligning the edges of the mesh bags disposed on the wicket.

10. The bag opening means of claim 9, wherein the bag retaining means comprises two longitudinally-extending bag guides downwardly depending from the wicket support unit and oriented substantially parallel to the wicket, each bag guide aligning a respective edge of the mesh bags disposed on the wicket.

11. The bag opening means of claim 10, wherein each bag guide is laterally adjustable, thereby allowing different sized mesh bags to be disposed from the wicket and aligned by the bag guides.

12. The bag opening means of claim 10, wherein each bag guide is coupled to the wicket support unit by a hinge, the hinge allowing the bag guide to move away from the wicket and being biased to align the bag guide substantially parallel to the wicket.

13. The bag opening means of claim 1, wherein the opener clamp sliding means comprises a pneumatic cylinder having a front end attached to the opener clamp and an opposite rear end disposed on the frame adjacent the back end of the bag holding means.

14. The bag opening means of claim 13, further comprising an adjustable motion limiter means for stopping the sliding motion of the opener clamp at the second desired distance from the outermost mesh bag, wherein the adjustable motion limiter means comprises a stop screw adjustably mounted to the frame, whereby the pneumatic cylinder of the opener clamp sliding means is adaptable to open mesh bags of different sizes.

15. The bag opening means of claim 1, further comprising a mat having a textured upper surface and being disposed on the air dam so that the pressurized fluid is directed through the portion the outermost mesh bag and onto the upper surface of the mat.

16. The bag opening apparatus of claim 1, wherein the pressurized fluid is pressurized air.

17. The bag opening apparatus of claim 1, further comprising:

a. a take-away clamp disposed intermediate the first clamp and the opener clamp positioned when the opening clamp is disposed at the second desired distance from the outermost mesh bag, the take-away clamp being movable between an attach position in which the take-away clamp clamps at least a portion of the outermost mesh bag and a release position;

b. means for moving the take-away clamp between the attach position and the release position; and c. means for conveying the take-away clamp between an opening location and a bag closing location.

18. The bag opening apparatus of claim 17, wherein the take-away clamp conveying means is a pneumatic rodless cylinder and wherein the take-away clamp operating means is a pneumatic cylinder.

19. The bag opening apparatus of claim 17, further comprising a conveyor disposed below the closed end of the outermost mesh bag wherein the conveyor supports the closed end of the outermost mesh bag.

20. The bag opening apparatus of claim 19, wherein the conveyor moves synchronously with the take-away clamp between an opening location and a bag closing location.

21. The bag opening apparatus of claim 1, further comprising a control system for coordinating the movements of the bag opening apparatus.

22. The bag opening apparatus of claim 1, wherein the air dam and the opener clamp are an integral unit so that the air dam is a clamping surface of the opener clamp.

23. The bag opening apparatus of claim 1, wherein the length between the closed end and the open end of the first side of the mesh bag is shorter than for the second side, and wherein the first clamp only contacts the second side of the outermost mesh bag.

24. An automatic bag opening apparatus for opening at least one bag, each bag having a first side having at least a portion thereof adapted to interface with a vacuum cup, a second side, two opposing edges, a closed end, and an opposite open end, the bag opening apparatus comprising:

a. a frame;

b. a bag holding means disposed on the frame for supporting at least a portion of the second side of each bag, the bag holding means having a forward end and an opposite back end, wherein the bag adjacent the forward end is the outermost bag;

c. a first clamp disposed on the frame adjacent the forward end of the bag holding means, the first clamp being movable between a hold position, in which the first clamp contacts a portion of the outermost mesh bag, and a release position;

d. means for moving the first clamp between the hold position and the release position;

e. a second clamp disposed on the frame adjacent the forward end of the bag holding means, the second clamp being movable between a grasp position and a free position, wherein, in the grasp position the second clamp alternately contacts a different portion of the outermost mesh bag than that contacted by the first clamp or a portion of the mesh bag adjacent the outermost mesh bag after that portion of the outermost mesh bag is partially pulled away from the bag holding means when the second clamp is in the free position;

f. means for moving the second clamp between the grasp position and the free position;

g. an opener clamp slidably mounted to the frame, the opener clamp being movable between a closed position, in which the opener clamp clamps at least a portion of the first side of the outermost bag, and an open position;

h. means for sliding the opener clamp between a first position at a first desired distance from the outermost mesh bag, to grasp the first side of the outermost mesh bag, and a second position at a second desired distance from the outermost mesh bag, to pull the first side of the outermost mesh bag away from its second side;

i. means for moving the opener clamp between the open and closed positions;

j. at least one vacuum cup slidably mounted to the frame;

k. means for sliding the vacuum cup between an opening position adjacent the open end of the first side of the outermost bag and a removed position; and l. means for separating the first and second sides of the outermost bag by creating a suction in the vacuum cup when it is adjacent the portion of the first side of the bag adapted to interface therewith and by then moving the vacuum cup away from the second side of the bag, wherein the opener clamp moves to a closed position to clamp at least a portion of the first side of the outermost bag, thereby allowing the outermost bag to be opened by the opener clamp sliding to the second desired distance from the outermost bag as the opener clamp holds the first side and the first clamp holds a portion of the second side.

25. The bag opening apparatus of claim 24, further comprising a control system for coordinating the movements of the bag opening apparatus.

26. A bag removal apparatus for removing at least one wicketed bag from a wicket, each bag having a first side, a second side, two opposing edges, a closed end, and an opposite open end, the bag removal apparatus comprising:

a. a frame;

b. a wicket disposed on the frame for supporting at least a portion of the bag and having a forward end and an opposite back end, wherein the bag adjacent the forward end is the outermost bag;

c. a first clamp disposed on the frame adjacent the forward end of the wicket, the first clamp being movable between a hold position, in which the first clamp contacts a portion of the outermost mesh bag, and a release position;

d. means for moving the first clamp between the bold position and the release position;

e. an opener clamp slidably mounted to the frame, the opener clamp being movable between a closed position, in which the opener clamp clamps at least a portion of the first side of the outermost bag, and an open position;

f. means for sliding the opener clamp between a first position at a first desired distance from the outermost mesh bag, to grasp the first side of the outermost mesh bag, and a second position at a second desired distance from the outermost mesh bag, to pull the first side of the outermost mesh bag away from its second side;

g. means for moving the opener clamp between the open and closed positions;

h. means for separating the first side of the outermost bag from the second side thereof, wherein the first clamp holds the second side and the opening clamp grasps the first side;

i. a take-away clamp disposed intermediate the first clamp and the opener clamp positioned when the opening clamp is disposed at the second desired distance from the outermost mesh bag, the take-away clamp being movable between an attach position in which the take-away clamp clamps at least a portion of the outermost mesh bag and a release position;

j. means for moving the take-away clamp between the attach position and the release position k. a second clamp disposed on the frame adjacent the forward end of the bag holding means, the second clamp being movable between a grasp position and a free position, wherein, in the grasp position the second clamp alternately contacts a different portion of the outermost mesh bag than that contacted by the first clamp or a portion of the mesh bag adjacent the outermost mesh bag after that portion of the outermost mesh bag is partially pulled away from the bag holding means when the second clamp is in the free position; and l. means for moving the second clamp between the grasp position and the free position.

27. The apparatus of claim 26, further comprising means for conveying the take-away clamp between an opening location and a bag closing location.

28. The bag removal apparatus of claim 27, wherein the take-away clamp conveying means is a pneumatic rodless cylinder and wherein the take-away clamp operating means is a pneumatic cylinder.

29. The bag removal apparatus of claim 28, further comprising means for advancing the bags toward the forward end of the wicket from the back end of the wicket.

30. The bag removal apparatus of claim 26, further comprising a conveyor disposed below the closed end of the outermost mesh bag wherein the conveyor supports the closed end of the outermost mesh bag.

31. The bag removal apparatus of claim 30, wherein the conveyor moves synchronously with the take-away clamp between an opening location and a bag closing location.

32. The bag removal apparatus of claim 26, further comprising a control system for coordinating the movements of the bag removal apparatus.

33. A bag removal apparatus for removing at least one wicketed bag from a wicket, each bag having a first side, a second side, two opposing edges, a closed end, and an opposite open end, the bag removal apparatus comprising:

a. a frame;

b. a wicket disposed on the frame for supporting at least a portion of the bag and having a forward end and an opposite back end, wherein the bag adjacent the forward end is the outermost bag;

c. a first clamp disposed on the frame adjacent the forward end of the wicket, the first clamp being movable between a hold position, in which the first clamp contacts a portion of the outermost mesh bag, and a release position;

d. means for moving the first clamp between the hold position and the release position;

e. an opener clamp slidably mounted to the frame, the opener clamp being movable between a closed position, in which the opener clamp clamps at least a portion of the first side of the outermost bag, and an open position;

f. means for sliding the opener clamp between a first position at a first desired distance from the outermost mesh bag, to grasp the first side of the outermost mesh bag, and a second position at a second desired distance from the outermost mesh bag, to pull the first side of the outermost mesh bag away from its second side;

g. means for moving the opener clamp between the open and closed positions;

h. means for separating the first side of the outermost bag from the second side thereof, wherein the first clamp holds the second side and the opening clamps the first side, wherein the separating means comprises:

i. an air dam slidably mounted to the frame;

ii. means for sliding the air dam between an opening position adjacent and outside of the open end of the first side of the outermost mesh bag and a removed position; and iii. means for directing a pressurized fluid through at least a portion of the open end of the first side of the outermost mesh bag adjacent its open end and onto the air dam;

i. a take-away clamp disposed intermediate the first clamp and the opener clamp positioned when the opening clamp is disposed at the second desired distance from the outermost mesh bag, the take-away clamp being movable between an attach position in which the take-away clamp clamps at least a portion of the outermost mesh bag and a release position; and j. means for moving the take-away clamp between the attach position and the release position.

34. A method of automatically opening at least one mesh bag, the mesh bag having a first side, a second side, two opposing edges, a closed end, and an opposite open end, comprising the steps of:

a. providing at least one mesh bag on a bag holding means for supporting the mesh bag, the bag holding means having a forward end and an opposite back end, wherein the mesh bag adjacent the forward end is the outermost mesh bag;

b. positioning a first clamp in contact with the outermost mesh bag;

c. locating an air dam adjacent the open end of the first side of the outermost mesh bag;

d. directing a pressurized fluid through at least a portion of the open end of the first side of the outermost mesh bag adjacent its open end and onto the air dam, thereby causing the portion of the mesh bag through which the pressurized fluid is directed to move towards the air dam;

e. moving an opener clamp to grasp the portion of the first side of the outermost bag that the pressurized fluid moved toward the air dam;

f. repositioning the air dam away from the outermost mesh bag; and g. moving the opener clamp a desired distance away from the forward end of the bag holding means, whereby the outermost mesh bag is opened by the opener clamp grasping its first side and the first clamp holding its second side.

35. The method of claim 34, wherein the air dam and the opener clamp are an integral unit so that the air dam is a clamping surface of the opener clamp, whereby the step of repositioning the air dam and moving the opener clamp are the same step.

36. The method of claim 34, further comprising the step of supporting the opened bag on a conveyor disposed beneath its closed end.

37. A method of automatically opening at least one mesh bag, the mesh bag having a first side, a second side, two opposing edges, a closed end, and an opposite open end, comprising the steps of:

a. providing at least one mesh bag on a bag holding means for supporting the mesh bag, the bag holding means having a forward end and an opposite back end, wherein the mesh bag adjacent the forward end is the outermost mesh bag;

b. positioning a first clamp in contact with the outermost mesh bag;

c. locating an air dam adjacent the open end of the first side of the outermost mesh bag;

d. directing a pressurized fluid through at least a portion of the open end of the first side of the outermost mesh bag adjacent its open end and onto the air dam, thereby causing the portion of the mesh bag through which the pressurized fluid is directed to move towards the air dam;

e. moving an opener clamp to grasp the portion of the first side of the outermost bag that the pressurized fluid moved toward the air dam;

f. repositioning the air dam away from the outermost mesh bag;

g. moving the opener clamp a desired distance away from the forward end of the bag holding means, whereby the outermost mesh bag is opened by the opener clamp grasping its first side and the first clamp holding its second side; and h. positioning at least one second clamp in contact with a portion of the mesh bag adjacent the outermost mesh bag when the outermost mesh bag is partially pulled away from the bag holding means.

38. The method of claim 37, further comprising, after the step of positioning the second clamp, the steps of:

a. clamping the opened mesh bag adjacent one of its edges with a take-away clamp;

b. positioning the first clamp to release the second side of the opened bag, whereby the second side of the opened bag is removed from the bag removal means; and c. moving the opener clamp to release the first side of the opened bag.

39. The method of claim 37, further comprising the steps of:

a. repositioning the first clamp to be in contact with the same mesh bag that the second clamp contacts, which is now the outermost mesh bag; and b. moving the second clamp away from the outermost mesh bag to be removed from the outermost mesh bag.

40. The method of claim 38, further comprising the step of conveying the opened bag by the take-away clamp to a bag closing location.

41. The method of claim 40, further comprising the step of supporting the opened bag on a conveyor disposed beneath the closed end of the opened bag, wherein the step of conveying the opened bag is performed by moving the take-away clamp synchronously with the conveyor.

42. A method of removing a wicketed bag from a wicket, the bag having a first side, a second side, two opposing edges, a closed end, and an opposite open end, comprising the steps of:

a. providing at least one bag on a wicket for supporting the bag, the wicket having a forward end and an opposite back end, wherein the bag adjacent the forward end is the outermost bag;

b. positioning a first clamp to contact the second side of the outermost bag;

c. separating the first side of the outermost bag from the second side;

d. moving an opener clamp to grasp a portion of the first side of the outermost bag;

e. moving the opener clamp a desired distance away from the forward end of the wicket, whereby the outermost bag is opened by the opener clamp grasping its first side and the first clamp holding its second side;

f. clamping the opened mesh bag adjacent one of its edges with a take-away clamp;

g. repositioning the first clamp to release the second side of the opened bag, whereby the second side of the opened bag is removed from the wicket without tearing the bag therefrom; and h. moving the opener clamp to release the first side of the opened bag; and i. positioning at least one second clamp in contact with a portion of the mesh bag adjacent the outermost mesh bag when the outermost mesh bag is partially pulled away from the bag holding means.

* * * * *